United States Patent [19]

Fukae et al.

[11] Patent Number: 4,664,507

[45] Date of Patent: May 12, 1987

[54] ELECTROPHOTOGRAPHIC PRINTER/COPIER

[75] Inventors: Kensuke Fukae, Monsey, N.Y.; Shozo Kaieda, Okazaki; Yoshiaki Matsunaga, Toyokawa, both of Japan

[73] Assignee: Kentek Information Systems, Inc., Allendale, N.J.

[21] Appl. No.: 700,813

[22] Filed: Feb. 11, 1985

[51] Int. Cl.[4] ..... G03G 15/00

[52] U.S. Cl. ..... 355/3 SH; 355/3 R; 355/14 R; 271/217; 271/219

[58] Field of Search ..... 355/3 R, 3 SH, 14 SH, 355/14 R; 271/197, 213, 217, 219, 221

[56] References Cited

U.S. PATENT DOCUMENTS

| | | | |
|---|---|---|---|
| 3,087,725 | 4/1963 | Duncan | 271/219 X |
| 3,819,266 | 6/1974 | Price | 355/14 R X |
| 4,247,193 | 1/1981 | Kaneko et al. | 355/3 SH X |
| 4,354,787 | 10/1982 | Gensiko et al. | 271/213 X |
| 4,519,700 | 5/1985 | Barker et al. | 355/14 SH X |

FOREIGN PATENT DOCUMENTS

| | | | |
|---|---|---|---|
| 1197191 | 11/1959 | France | 271/219 |
| 0038072 | 3/1979 | Japan | 271/213 |

*Primary Examiner*—A. C. Prescott
*Assistant Examiner*—C. Romano
*Attorney, Agent, or Firm*—Marmorek, Guttman & Rubenstein

[57] ABSTRACT

An electrographic printer/copier includes a paper path which is easily accessed from the top of the machine and permits copies to be collated automatically. The machine includes a paper tray which adjusts to organize successive pages into related reports.

5 Claims, 3 Drawing Figures

ELECTROPHOTOGRAPHIC PRINTER/COPIER

TECHNICAL FIELD

This invention relates to electrophotographic printing machines having simplified paper paths and, in particular, to transfer station arrangements in which a latent image is developed on the underside of the copy sheet.

BACKGROUND OF THE INVENTION

Electrophotographic printing is achieved by a process which includes creating a latent image by exposing a uniformly charged photoconductive member to a light source containing the information to be preserved; developing the latent image thus created; and transferring the developed image onto a suitable medium such as paper to form the hard copy. In an electrophotographic copier, the information is obtained by focusing the light reflected from the surface of a printed page, or other original, onto the photoconductive member. In an electrophotographic printer, a modulated light source scans the surface of the photoconductive member.

Many printers currently on the market are essentially copiers in which the optics associated with the imaging portion of the copier has been replaced with the much smaller light-scanning apparatus. In such cases, the paper path tends to follow a rather serpentine path from the paper source tray, under the optical imaging region of the original copier engine, and then up the other side of the machine to the output tray. This is not a problem so long as the machine operates properly. It is a problem, however, when there is a paper jam and layer upon layer of apparatus must be peeled away to reach the portion of the paper path along which the jam has occurred.

It is, therefore, a first object of the present invention to simplify the paper path in electrophotographic printers.

Another inconvenience typical of prior art printers is that the image is transferred to the top surface of the hard copy material. As a result, as the copies are deposited in the output tray they accumulate in reverse order, with the last page on top and the first page on the bottom of the stack. Thus, each series of pages must then be collated either by hand or by means of additional apparatus.

It is, accordingly, a second object of the present invention to print copies such that collation occurs automatically.

Having established the ability to collate, various printing tasks can be simplified. For example, it would be convenient to be able to run off many copies of the same, multiple page report, or copies of different, multiple page reports. Inasmuch as each is collated in the manner described hereinabove, the several reports should be readily available for distribution. However, if the conventional output tray is used, a number of difficulties are encountered. For example, as the copies deposited on the output tray build up, a point is reached where subsequent copies are no longer deposited properly. This would limit the number of copies that could be made before the tray required emptying. A second problem resides in the fact that there is no convenient way of determining where one report ends and the next report begins. Thus, the stack would have to be examined, page by page, in order to separate successive copies of reports.

Thus, it is a further object of the invention to provide a means whereby more copies can be made before the output tray must be emptied and, in addition, to provide means for distinguishing between selected groups of copies.

SUMMARY OF THE INVENTION

In an electrophotographic printer, in accordance with one aspect of the present invention, the paper path extends along the top of the machine. The photoconductive member is located below the paper path, and transfer of the toner material takes place between the photoconductive member and the underside of the paper. In the specific embodiment of the invention to be described in greater detail hereinbelow, a vacuum transport located above the paper path transfers the paper between the transfer region and the fuser.

Because the printer surface is face down, successive pages of copy collate automatically. In addition, because the photoconductive member, and essentially all the other components of the printer are located below the paper path, lifting the top of the machine exposes the entire paper path, making it a relatively simple matter to clear paper jams.

In accordance with a second aspect of the present invention, the output tray is provided with means for moving in two directions relative to the direction of the copy movement. Vertical movement is made responsive to the weight of the deposited copy. Thus, as the number of deposited copies increases, the tray is caused to move downward. As a result the location of the surface upon which successive copies are deposited remains relatively constant.

A second, horizontal movement is made in response to the number of copies that have been deposited. Means are provided for counting the number of pages that have been printed. When the count is equal to a preselected number, say corresponding to the required number of pages in a report, a sideway-jog command is given by the computer. In response, the output tray is displaced horizontally in a first direction to permit the accumulation of a second report in a differentiated file. Following the deposition of a second group of copies (viz: second report), the tray is again shifted in the opposite direction. In this manner, each group of copies (report) can be readily distinguished from the adjacent groups. The movement of the tray is controlled by a microprocessor which is responsive to operator-entered signals.

DETAILED DESCRIPTION

Figure 1:
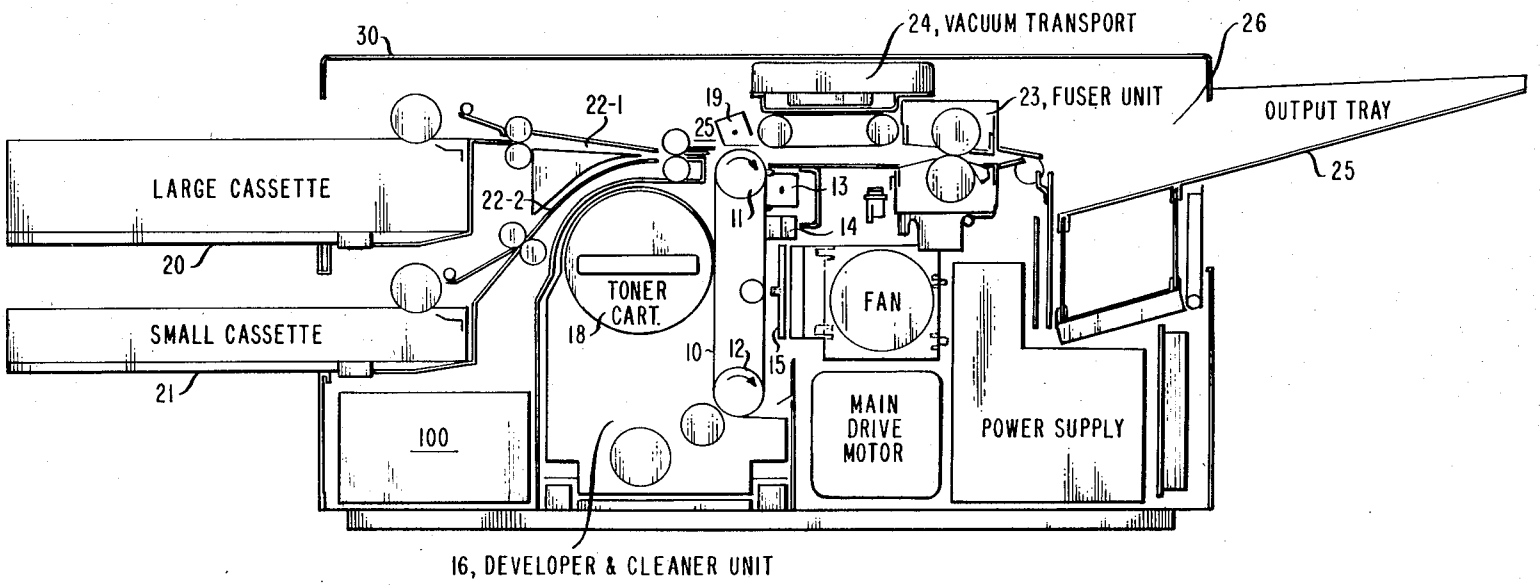
FIG. 1 is a block diagram of an electrophotographic printer in accordance with the present invention.

FIG. 1 is a block diagram showing the basic components of an electrophotographic printer in accordance with one aspect of the present invention. Such printers typically include a photoconductive member which, in the illustrative embodiment, is a belt 10. The latter is rotated clockwise by means of rollers 11 and 12. Located along the right side of the belt, as viewed in FIG.

1, is a main charger 13, erase lamps 14, and an optical print head 15. On the left side of the belt is the developer/cleaner unit 16, which combines the functions of cleaning and developing. This unit contains a toner cartridge 18 for convenient handling. Located at the top of the belt path is a transfer charger unit 19.

The copy material, i.e., paper, is derived from either of two convenient paper handling cassettes 20, 21. The paper is directed along either of two paper paths 22-1, 22-2 to the image transfer region 25 located between the upper roller 11 and the transfer charger unit 19. The paper is then transported to a fuser unit 23 by means of a vacuum transport unit 24, and finally deposited in an output tray assembly 25.

The operation of the printer involves two rotations of belt 10 per copy. During the first rotation, the belt is uniformly charged as it passes main charger 13. A latent image is generated by means of the optical print head 15, which can be either a laser or an LED that is intensity modulated by means not shown. The modulated light beam scans the uniformly charged belt as it passes through the image forming region. The latent image thus formed is developed by the deposition of toner by the developer/cleaner unit 16 operating in the develop mode. The belt then enters the transfer region wherein the developed image is transferred to the copy material. This completes the first rotation of the belt.

During the next revolution of the belt, the main charger 13, and the printer head 15, are disabled while the erase lamps are activated and the developer/cleaner unit is switched to the clean mode. Thus, as the belt rotates following image transfer, the photoconductive belt is discharged by the erase lamps, and the excess toner is removed by the developer/cleaner unit. The belt is thereby readied for the next copy.

As noted hereinabove, it is a feature of the present invention that the copy is formed along the underside of the paper. This is accomplished by locating the photoconductive member 10 below the paper path. Thus, in the illustrative embodiment of FIG. 1, the transfer region is located above roller 11 and the paper enters the region with its lower surface in contact with belt 10.

To avoid smudging the copy following image transfer, the printed paper is transported to the fuser unit 23 by means of a vacuum transport unit 24 whose only contact is with the upper side of the paper.

After leaving the fuser unit 23, the printed copy enters the output tray with its printed side down. As indicated hereinabove, an advantage of this arrangement is that the printed copies are automatically collated. An additional advantage of placing the photoconductive member below the paper path is that the latter is readily accessible, thus making it possible to clear paper jams more easily. As can be seen in FIG. 1, the paper path extends along the top of the printer and is accessible simply by lifting the lid 30 of the machine.

Figure 2:
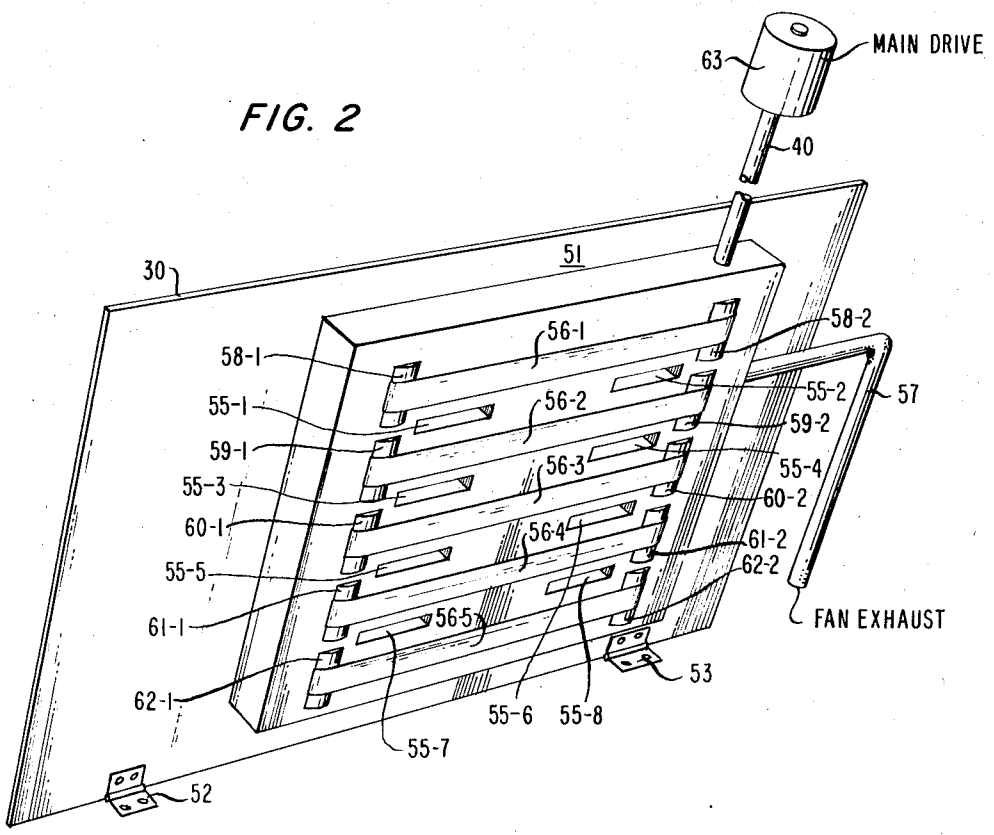
FIG. 2 shows an illustrative embodiment of the vacuum transport.

FIG. 2 shows an illustrative embodiment of a vacuum transport 51 for use in connection with the present invention. In this particular arrangement, transport 51 is mounted on printer lid 30; the latter, advantageously, is connected to the body of the printer by means of hinges 52, 53. So arranged, the paper path can be conveniently reached in the event of a paper jam simply by lifting lid 30.

Basically, the transport unit comprises a rectangular enclosure which is provided with a plurality of apertures 55-1 through 55-8, and a plurality of transport belts 56-1 through 56-5. The enclosure contains an exhaust fan (not shown) which causes air to be drawn into the enclosure through the apertures, exhausting through a tube designated 57.

Each belt is mounted on a pair of wheels 58-1, 58-2; 59-1, 59-2 . . . ; 62-1, 62-2, one set of which 58-2, 59-2; . . . 62-2 is mounted on a common shaft 40 driven by means of a coupling to the engine main drive 63.

When shaft 40 is driven, the copy material is drawn across the transport unit by the several belts. The slight vacuum created by the fan keeps the back of the copy material in contact with the belts. Consequently, the copy is caused to move with its printed side undisturbed.

Clearly, other types of vacuum transports can be employed. See, for example, U.S. Pat. No. 4,455,018.

While this aspect of the invention is described in the context of a printer, it is readily apparent that it can also be employed in a copier as well. While a copier has a more complicated paper path, for the reason described hereinabove, the photoconductive member (belt 10 of FIG. 1) can, nevertheless, be placed below the paper path so as to print onto the underside of the paper.

Figure 3:
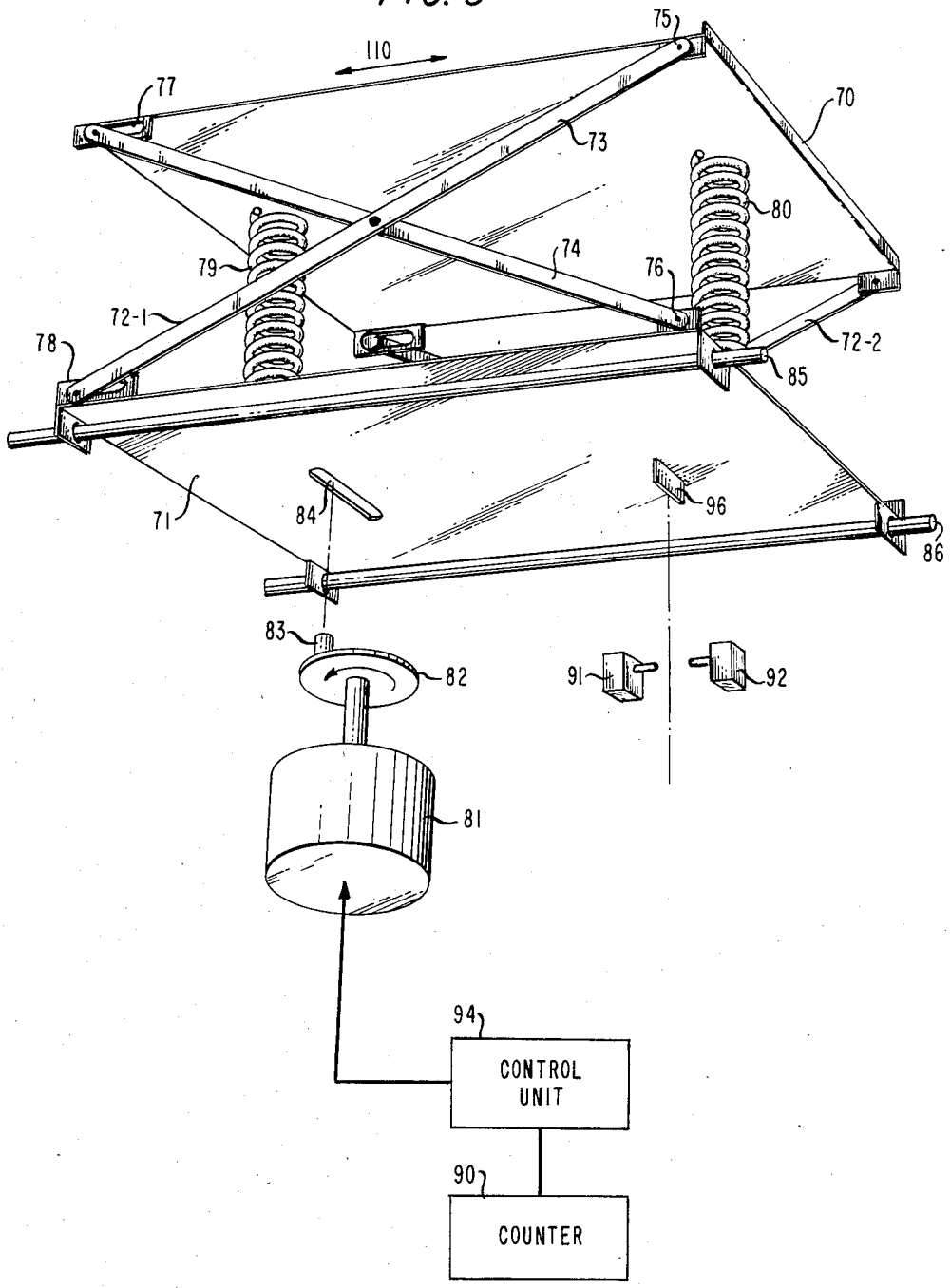
FIG. 3 shows an illustrative embodiment of an output tray assembly in accordance with the invention.

FIG. 3 shows an illustrative embodiment of an adjustable output tray in accordance with a second aspect of the present invention. As indicated hereinabove, the tray is arranged so as to move in the vertical direction as a function of the weight of the copy material deposited on it, and to move in the horizontal direction as a function of the number of copies deposited. Accordingly, the tray, identified as upper platform 70, is supported on a lower platform 71 by means of two pairs of crossed members which form a front scissors 72-1 and a rear scissors 72-2. One of the members of scissors 72-1, i.e., 73, is pivotally mounted at one of the front corners 75 of upper platform 70. Similarly, one end of member 74 is pivotally mounted to the adjacent end of platform 71. The other ends of members 73 and 74 are mounted in elongated slots 77, 78 at the other corners of the front end of platforms 70 and 71. The members of the rear scissors 72-2 are similarly mounted at the corners at the far ends of the platforms. Mounted in this manner, the upper platform is free to move in the vertical direction. The amount of movement is controlled by means of a pair of support springs 79 and 80 which extend between the two platforms.

Horizontal movement of the tray assembly is controlled by a motor 81 along whose drive shaft there is attached a wheel 82 from which a pin 83 extends. The latter fits into a slot 84 cut into the lower platform 71 which is free to move horizontally along two supporting shafts 85 and 86.

In operation, the level of the empty tray is set by the weight of the tray and the characteristics of the supporting springs. As the number of copies increases, their collective weight further compresses the springs and the tray moves downward. In this manner the level of the top of the pile of copies tends to remain constant, thereby permitting a greater accumulation of copies than would otherwise be possible. Simultaneously, the number of copies is being counted. As a predetermined number set by the host computer command, motor 81 is activated, causing the output tray assembly to be displaced horizontally. The amount of displacement is determined by the distance between the center of wheel 82 and pin 83.

In the illustrative embodiment, a pair of switches 91 and 92 are used to detect when the lower platform has reached the limit of travel, and signals the control unit 94 to stop the motor. A tab 96, extending from platform 71, activates the respective switches. In this manner, the output tray is horizontally displaced in opposite directions transverse to the paper path, as indicated by arrow 110, as a function of the number of copies.

Anyone of a variety of means for counting copy can be employed. Inasmuch as its takes two rotations of belt 10 to make a copy, a counter can be used to count every second rotation and to transmit the number to a comparator in which a preselected number has been stored. Whenever the count is equal to the stored number, a signal is transmitted to the main drive motor and the tray is displaced. Clearly, more sophisticated systems can be used in those cases in which the preselected number changes with the copy. The various controls herein such as counters, comparators, and processors are included in a control circuit represented by block 100 in FIG. 1.

What is claimed is:

1. An electrographic printing apparatus for producing hard copies of information to be recorded, comprising a housing open on top, a lid for covering the top of the housing, a source of copy material and an output tray for receiving said copy material after it is imprinted, a copy material path along which said copy material travels between said source and said output tray, said copy material path being substantially contained in a single plane located in said housing near the top thereof so that access to said paper path may be achieved by lifting said lid, thereby rendering maintenance of said printing apparatus relatively easy, a photoconductive member for storing a latent electrostatic image of the information to be imprinted, said photoconductive member being located below said planar paper material path and coming into contact with the underside of said copy material in a transfer zone located in said planar copy material path to transfer said latent electrostatic image to the underside of said copy material, said copy material being in contact with said photoconductive member substantially only in said transfer zone, transport means attached to the underside of said lid and located above said plane immediately downstream of said transfer zone to aid in separating said paper from said photoconductive member, said transport means being adapted to contact only the upper surface of said copy material.

2. Apparatus according to claim 1 wherein said information is copied from an original.

3. Apparatus according to claim 1 wherein said information is derived from a modulated light source which scans across said photoconductive member.

4. An electro-photographic printing apparatus including an output tray, said apparatus including means for moving the output tray back and forth along a horizontal straight path as a function of the number of copies deposited thereon, and vertically as a function of the weight of the copies deposited thereon.

5. Apparatus in accordance with claim 4 wherein said means includes:

a motor along whose shaft there is a wheel having a pin extending therefrom;

means for supporting said tray having a slot for receiving said pin; and means responsive to the number of copies deposited in said tray for causing said motor to rotate and thereby displace said tray along said horizontal straight line path.

* * * * *